US008501666B2

(12) United States Patent
Majumdar et al.

(10) Patent No.: US 8,501,666 B2
(45) **Date of Patent: *Aug. 6, 2013**

(54) IMAGE RECEIVER ELEMENTS WITH AQUEOUS DYE RECEIVING LAYER

(75) Inventors: Debasis Majumdar, Rochester, NY (US); Teh-Ming Kung, Rochester, NY (US); Catherine A. Falkner, Rochester, NY (US); Yongcai Wang, Webster, NY (US); Cheryl Lenhard, Rochester, NY (US); Paul D. Yacobucci, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 267 days.

This patent is subject to a terminal disclaimer.

(21) Appl. No.: 13/029,397

(22) Filed: Feb. 17, 2011

(65) Prior Publication Data

US 2011/0143060 A1 Jun. 16, 2011

Related U.S. Application Data

(63) Continuation-in-part of application No. 12/533,081, filed on Jul. 31, 2009, now Pat. No. 8,404,332.

(51) Int. Cl.
*B41M 5/50* (2006.01)

(52) U.S. Cl.
USPC ..... 503/227; 428/32.39

(58) Field of Classification Search
None
See application file for complete search history.

(56) References Cited

U.S. PATENT DOCUMENTS

| | | | | |
|---|---|---|---|---|
| 4,962,080 | A | 10/1990 | Watanabe | |
| 5,356,859 | A | 10/1994 | Lum et al. | |
| 5,411,931 | A | 5/1995 | Kung | |
| 5,525,445 | A | 6/1996 | Falkner et al. | |
| 5,529,972 | A | 6/1996 | Ramello et al. | |
| 5,876,910 | A | 3/1999 | Anderson et al. | |
| 6,096,685 | A | 8/2000 | Pope et al. | |
| 6,268,101 | B1 | 7/2001 | Yacobucci et al. | |
| 6,495,490 | B2 * | 12/2002 | Hanada et al. | 503/200 |
| 7,189,676 | B2 | 3/2007 | Bourdelais et al. | |
| 7,514,028 | B2 | 4/2009 | Kung et al. | |
| 2008/0248951 | A1 | 10/2008 | Yoshitani et al. | |

* cited by examiner

*Primary Examiner* — Bruce H Hess
(74) *Attorney, Agent, or Firm* — J. Lanny Tucker

(57) ABSTRACT

A thermal, non-silver halide-containing image receiver element includes a support and an aqueous-coated image receiving layer. This receiving layer comprises a water-dispersible polymer having a polyurea or polyurethane backbone and up to 25 weight % of the water-dispersible polymer comprising polysiloxane side chains that are covalently attached to the backbone, each of the side chains having a molecular weight of at least 500. Aqueous dispersions of polyester ionomers and crosslinking agents can also be present.

17 Claims, No Drawings

IMAGE RECEIVER ELEMENTS WITH AQUEOUS DYE RECEIVING LAYER

CROSS-REFERENCE TO RELATED APPLICATIONS

This is a Continuation-In-Part Application of commonly-assigned; U.S. patent application Ser. No. 12/533,081, filed Jul. 31, 2009, by Debasis Majumdar et al, now granted as U.S. Pat. No. 8,404,332, the disclosure of which is incorporated herein.

FIELD OF THE INVENTION

This present invention relates to image receiver elements that have at least one aqueous-coated image receiving layer containing a water-dispersible polymer (latex) having a polyurea or polyurethane backbone and polysiloxane side chains. Such image receiving elements can be thermal dye transfer receiver elements that can be used in a thermal assembly in combination with a dye image donor element.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element in an image assembly. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Dye receiver elements used in thermal dye transfer generally include a support (transparent or reflective) bearing on one side thereof a dye image-receiving layer, and optionally additional layers, such as a compliant or cushioning layer between the support and the dye receiving layer.

Various approaches have been suggested for providing a thermal dye receiving layer. Solvent-coating of the dye receptive polymers is a commonly used approach. Such methods involve expensive, polluting, and hazardous manufacturing processes. To reduce risks of fire, explosions, and other accidents, special precautions and expensive manufacturing apparatus are needed for handling the organic solvent solutions used in that type of manufacture. Another approach involves hot-melt extrusion of the dye receiving polymers onto a support. Such methods restrict the type of materials that can be incorporated into the layer due to the high temperatures required for the extrusion process. Still another approach utilizes aqueous coating of water-soluble or water-dispersible polymers to provide the dye receiving layer.

Although such aqueous coating methods reduce or eliminate the use of hazardous solvents, and high temperature coating processes, such aqueous-coated layers cause problems in typical customer printing environments where high speed printing requires a smooth separation of donor ribbon element and receiver element with no sticking between the two surfaces. Printing in high humidity environments can be particularly troublesome for sticking with typical aqueous-coated receivers. Moreover, such receiver elements are often deficient in providing adequate dye density. Furthermore, imaged prints bearing the aqueous coated layer are not robust in situations where the print is contacted with water and separation of the layer can occur.

Thus, a common problem with the use of some thermal dye donor elements and corresponding thermal dye receiver elements is that at high dye transfer temperatures, the polymers in the elements can soften and cause adherence between the elements, resulting in sticking and tearing of the elements during separation. Areas within the donor element (other than the transferred dyes) can adhere to the receiver element, rendering the receiving element useless.

This problem has been addressed in many ways including the incorporation of release agents such as silicone waxes and oils as lubricating materials in either or both elements. For example, U.S. Pat. No. 5,356,859 (Lum et al. describes the use of dimethyl siloxane in thermal dye image receiver elements and U.S. Pat. No. 4,962,080 (Watanabe) describes the use of alcohol-modified silicone oils in a similar manner.

U.S. Pat. No. 7,189,676 (Bourdelais et al.) describes an image receiver sheet comprising a crosslinked co-polymer of polyester and a lubricating polymer comprising a polyurethane wherein the crosslinked copolymer is formed from a water dispersion. Such copolymers are difficult to synthesize and are rarely commercially available. U.S. Pat. No. 5,529,972 (Ramello et al.) describes an image receiver sheet with a dye receiving layer comprising a dried polymeric latex wherein the latex may be selected from a group including polyurethane latexes. The technology as described in this patent does not provide adequate maximum densities. In addition, a separate layer of siloxane material is coated above the receiver layer to provide protective and release properties. This requires an additional manufacturing operation. U.S. Pat. No. 4,962,080 (Watanabe) describes an image receiver sheet with an aqueous dye receiving layer, wherein the receiver layer also comprises silicone oil. This patent shows that very low densities are obtained with this technology due to the thick receiving layers employed.

There remains a need to reduce the possibility of sticking of image receiver elements with donor elements when images are transferred at high temperatures without loss in desired imaging properties. In addition, it would be desired to provide such elements using aqueous-coated formulations so that solvent coating can be minimized. Thus, it would be advantageous to provide an aqueous-coated dye receiving layer that enables high-speed printing without sticking problems. It would also be advantageous if the aqueous dye receiving layer technology could also provide high printing density and be used to provide water-fast prints.

SUMMARY OF THE INVENTION

This invention provides a thermal, non-silver halide-containing image receiver element comprising a support and having thereon an aqueous-coated image receiving layer comprising:

a) a water-dispersible polymer having a polyurea or polyurethane backbone and up to 25 weight % of the water-dispersible polymer comprising polysiloxane side chains that are covalently attached to the backbone, each of the side chains having a molecular weight of at least 500.

In some embodiments, the image receiver element has an image receiving layer that further comprises:

b) a crosslinkable water-dispersible polyester ionomer having a Tg of at least 0 and up to and including 100° C., and c) a crosslinking agent for the polyester ionomer.

This invention also provides an imaging assembly comprising the image receiver element of this invention in thermal association with a thermal dye donor element.

The image receiving elements of this invention can be used in an assembly with an image donor element, for example as an assembly of a thermal dye transfer receiver element and a thermal dye donor element.

The elements of the present invention can be used to provide either a glossy or matte image or material, which image can be borderless or have a border.

The present invention includes a thermal dye transfer receiver that can be image-wise printed with dyes that migrate from a thermal dye transfer donor be means of heating, the receiver comprising a support and at least one dye receiving layer coated on at least one side of said support. The dye receiving layer(s) comprises a dye-accepting polyurethane dispersion wherein the polyurethane further comprises a pendant siloxane moiety.

Polyurethane compounds have been known since the discovery in 1937 of diisocyanate addition polymerization. The term "polyurethane compound" does not mean a polymer that only contains urethane groups, but means all those polymers which contain a significant number of urethane groups, regardless of what the rest of the molecule may be. Homopolymers of isocyanates are usually referred to as isocyanate polymers. Usually polyurethane compounds are obtained by the reaction of polyisocyanates with polyhydroxy compounds, such as polyether polyols, polyester polyols, castor oils, or glycols, but compounds containing free hydrogen groups such as amine and carboxyl groups may also be used. Thus, a typical polyurethane compound may contain, in addition to urethane groups, aliphatic and aromatic hydrocarbon residues, ester groups, ether groups, amide groups, and urea groups.

The thermal, non-silver halide-containing image receiver elements of this invention exhibit several important advantages, not all of which may be found in every embodiment. The ratio of water-dispersible polymer to the polyester ionomer can be adjusted to optimize dye transfer efficiency to maximize $D_{max}$ or image density and other sensitometric properties. In addition, the image receiving layer can be coated out of aqueous formulations thereby avoiding solvent coating. The water-dispersible polymer used in the invention has polysiloxane side chains covalently attached to the polymer backbone.

DETAILED DESCRIPTION OF THE INVENTION

Definitions

Unless otherwise indicated, the terms "image receiver element", "thermal dye transfer receiver element", "thermal receiver element", and "receiver element" refer to embodiments of the present invention.

The image receiver element has one or more layers on a suitable substrate, at least one layer being an aqueous-coated image receiving layer (IRL). Other useful layers are described below.

In one embodiment of the invention, the image receiver element is a thermal dye transfer receiver element comprising a support and one or more layers disposed thereon. In other embodiments, the image receiver element can be used in other techniques governing the thermal transfer of an image onto the imaging element. Such techniques include thermal dye transfer, electrophotographic printing, thermal wax transfer, or inkjet printing. Such elements then comprise at least one, respectively, thermal dye receiving layer, electrophotographic image receiving layer, thermal wax receiving layer, and inkjet receiving layer. The imaging elements may be desired for reflection viewing, that is having an opaque support, or desired for viewing by transmitted light, that is having a transparent support. The image receiving elements do not contain silver halide or silver halide emulsions as are common in photographic or photothermographic elements.

The terms as used herein, "top", "upper", and "face" refer to the side or toward the side of the imaging member bearing the imaging layers, image, or receiving the image.

The terms "bottom", "lower side", and "back" refer to the side or toward the side of the imaging member opposite from the side bearing the imaging layers, image, or receiving the image.

The term "non-voided" as used to refer to a layer being devoid of added solid or liquid matter or voids containing a gas.

The term "voided" will include materials comprising microvoided polymers and microporous materials known in the art. A foam or polymer foam formed by means of a blowing agent is not considered a voided polymer for purposes of the present invention.

"Image receiving layer" (IRL) includes a "dye receiving layer" (DRL).

The term "aqueous-coated" refers to layers that are coated from a coating composition or formulation that contains water as the predominant (greater than 50 volume %) coating medium.

Aqueous Image Receiving Layer

This layer includes a water-dispersible polymer (latex) having a polyurea or polyurethane backbone. Moreover, up to 25 weight % of the polymer (typically at least 5 and up to and including 20 weight %) comprises polysiloxane side chains that are covalently attached to the backbone. Each of these side chains has a molecular weight of at least 500 and typically at least 500 and up to and including 10,000.

Conventional processes for making polyurethane dispersions involve the steps of preparing a prepolymer having a relatively low molecular weight and small excess of isocyanate groups and chain-extending during the dispersion process. Besides the raw materials, the polyurethane dispersions sold by various manufactures differ in the process used to prepare the prepolymers (for example, a solvent-free polymer process, Ketimine and Ketazine process, Hybrid systems, and Ethyl Acetate process) and the type of chain extender used in the dispersion step. Such materials and processes have been disclosed in, for example, U.S. Pat. No. 4,335,029 (Dadi et al.), in "Aqueous Polyurethane Dispersions" by B. K. Kim, Colloid & Polymer Science, Vol. 274, No. 7 (1996) 599-611 Steinopff Verlag 1996, and in "Polyurethane Dispersion Process" by Manea et al. Paint and Coating Industry, January 2000, page 30.

The polyurethane useful for the practice of this invention is generally prepared without involving the chain-extension step during the dispersion step. It is desired to have the chemical reaction for forming the urethane or urea linkages prior to the dispersion step. This will insure that the polyurethane dispersion used will have well-controlled molecular weight and molecular weight distribution and be free of gel particles.

In one of the processes, the polyurethane useful for the present invention is prepared in a water miscible organic solvent such as tetrahydrofuran, followed by neutralizing the hydrophilic groups, for example carboxylic acid groups, with an organic base, for example triethylamine. The polyurethane solution is then diluted with doubly distilled de-ion water. The water miscible organic solvent is removed by distillation to form a stable polyurethane dispersion. The polyurethane particles are formed by precipitation during the solvent evaporation.

In a second useful process, the polyurethane useful for the invention is prepared in a water-immiscible organic solvent such as ethyl acetate. The polyurethane is then neutralized with an organic base and water is added to form an aqueous dispersion comprising primarily minute drops of polyurethane-water-immiscible organic solvent solution suspended in water. The water-immiscible organic solvent is then removed to form the desired polyurethane dispersion.

Polyureas are generally prepared by reacting an amine terminated diamine or polyamine compound with a diisocyanate or a polyfunctional isocyanate in the presence of a suitable catalyst and optional additives.

Polyurethanes are generally prepared by reacting a polyol with a diisocyanate or a polymer isocyanate in the presence of suitable catalysts and additives. These reactions are well known in the art and generally utilize various polymerization catalysts. Thus, polyurea or polyurethane backbones are formed.

The polyureas and polyurethanes are provided with the desired polysiloxane side chains using various techniques. In some embodiments, the siloxane units are attached to unreacted isocyanate functional groups in the backbone by reaction of a hydroxyl functional group in the siloxane in the presence of a suitable catalyst.

In other embodiments, the polysiloxane side chains are derived from a siloxane-containing diol or diamine can be represented by the following Structure (SX-1) that is reacted with an appropriate polyisocyanate:

(SX-1)

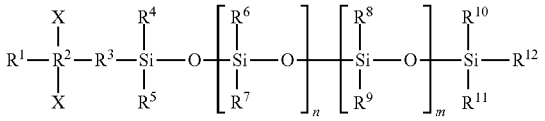

wherein X is an amino or hydroxyl group, $R^1$ through $R^{12}$ are independently substituted or unsubstituted alkyl or substituted or unsubstituted aryl groups, and n and m are independently 0 to 500 such that the sum of n and m is at least 10 and up to and including 500.

The water-dispersible polymer is generally present in the image receiving layer in an amount of at least 1 and up to and including 99 weight %, or typically at least 5 and up to and including 95 weight %, based on total layer dry weight.

The aqueous-coated image receiving layer can also contain one or more crosslinkable water-dispersible polyester ionomers, each of which has a Tg of at least 0 and up to and including 100° C. (typically at least 20 and up to and including 80° C.). The term "polyester ionomer" refers to polyesters that contain at least one ionic moiety. Such ionic moieties function to make the polymer water dispersible. These polymers are substantially amorphous in nature. The Tg of the polymer also plays an important role in its use in the thermal receiver element. Although lower Tg materials are desired for higher dye transfer efficiency, too low a Tg can cause undesirable dye bleed, blocking of rolls, and other physical deficiencies. It is desired that the Tg of these polyester ionomers is at least 0 and up to and including 100° C., typically at least 20 and up to and including 80° C. and more typically at least 25 and up to and including 60° C. The Tg of a polymer can be determined using a standard method such as one using differential scanning calorimetry, where differential power input (watt/fram) is monitored for the sample polymer and a reference as they are both heated at a constant rate and maintained at the same temperature. Typically, the differential power input is plotted as a function of the temperature and the temperature at which the plot undergoes a sharp slope change is assigned as the Tg of the sample polymer.

The substantially amorphous polyester ionomers comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (for example, anhydrides, diesters, or diacid halides). Such diols, dicarboxylic acids, and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyester ionomers are known in the art. The polymer precursors are condensed in a ratio of at least 1 mole of diol for each mole of dicarboxylic acid in the presence of a suitable catalyst at a temperature of at least 125° and up to and including about 300° C. Condensation pressure is typically at least 0.1 mm Hg and up to and including one or more atmospheres. Low-molecular weight by-products are removed during condensation, for example by distillation or another suitable technique. The resulting condensation polymer is polycondensed under appropriate conditions to form a polyester resin. Polycondensation is usually carried out at a temperature of at least 150° and up to and including 300° C. and a pressure very near vacuum, although higher pressures can be used.

The ionic moieties in these polyester ionomers can be provided by either ionic diol recurring units or ionic dicarboxylic acid recurring units, but usually by the latter. Such ionic moieties can be anionic or cationic in nature. Other exemplary ionic groups include sulfonic acid, quaternary ammonium and disulfonylimino, and their salts and others known to a worker of ordinary skill in the art. In some embodiments, the polyester ionomers comprise at least 2 and up to and including 25 mole percent, based on total moles of dicarboxylic acid recurring units, of ionic dicarboxylic acid recurring units.

Ionic dicarboxylic acids found to be particularly useful are those having units represented by the formula:

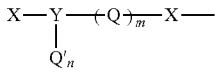

wherein each of m and n is 0 or 1 and the sum of m and n is 1; each X is carbonyl; Q has the formula:

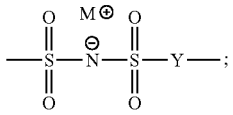

Q' has the formula:

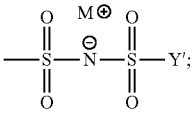

Y is a divalent aromatic radical, such as arylene (for example, phenylene, naphthalene, and xylylene) or arylidyne (for example, phenenyl and naphthylidyne); Y' is a monovalent aromatic radical, such as aryl, aralkyl or alkaryl (for example phenyl, p-methylphenyl, and naphthyl), or alkyl having from 1 to 12 carbon atoms, such as methyl, ethyl, isopropyl, n-pentyl, neopentyl, and 2-chlorohexyl, and typically from 1 to 6 carbon atoms; and M is a solubilizing cation such as a monovalent cation such as an alkali metal or ammonium cation.

Exemplary dicarboxylic acids and functional equivalents from which such ionic recurring units are derived are 3,3'-[(sodioimino)disulfonyl]dibenzoic acid;
3,3'-[(potassioimino)disulfonyl]dibenzoic acid,
3,3'-[(lithioimino)disulfonyl]dibenzoic acid;
4,4'-[(lithioimino)disulfonyl]dibenzoic acid;
4,4'-[(sodioimino)disulfonyl]dibenzoic acid;
4,4'-[(potassioimino)disulfonyl]dibenzoic acid; 3,4'-[(lithioimino) disulfonyl]dibenzoic acid;
3,4'-[(sodioimino)disulfonyl]dibenzoic acid;
5-[4-chloronaphth-1-ylsulfonyl(sodioimino)sulfonyl]isophthalic acid; 4,4'-[(potassioimino)disulfonyl]dinaphthoic acid;
5-[p-tolylsulfonyl(potassioimino)sulfonyl]isophthalic acid; 4-[p-tolylsulfonyl(sodioimino)sulfonyl]-1,5-naphthalenedicarboxylic acid;
5-[n-hexylsulfonyl(lithioimino)sulfonyl]isophthalic acid; 2-[phenylsulfonyl(potassioimino)sulfonyl]terephthalic acid and functional equivalents thereof. These and other dicarboxylic acids useful in forming preferred ionic recurring units are described in U.S. Pat. No. 3,546,180 (Caldwell et al.) the disclosure of which is incorporated herein by reference.

Ionic dicarboxylic acid recurring units can also be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Publication 1,470,059.

Ionic dicarboxylic acid recurring units can also be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (noted above).

The amorphous polyester ionomers generally comprise at least 75 and up to and including 98 mole percent, based on total moles of dicarboxylic acid recurring units, of dicarboxylic acid recurring units which are nonionic in nature. Such nonionic units can be derived from any suitable dicarboxylic acid or functional equivalent which will condense with a diol as long as the resulting polyester is substantially amorphous. Such units have the formula:

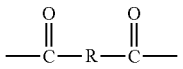

wherein R is saturated or unsaturated divalent hydrocarbon. For example, R is alkylene of 2 to 20 carbon atoms, (for example, ethylene, propylene, neopentylene, and 2-chlorobutylene); cycloalkylene of 5 to 10 carbon atoms, (for example, cyclopentylene, 1,3-cyclohexylene, 1,4-cyclohexylene, and 1,4-dimethylcyclohexylene); or arylene of 6 to 12 carbon atoms, (for example, phenylene and xylylene). Such recurring units are derived from, for example, phthalic acid, isophthalic acid, terephthalic acid, malonic acid, succinic acid, glutaric acid, adipic acid, suberic acid, 1,3-cyclohexane dicarboxylic acid, and functional equivalents thereof.

The dicarboxylic acid recurring units are linked in a polyester by recurring units derived from difunctional compounds capable of condensing with a dicarboxylic acid or a functional equivalent thereof. Such difunctional compounds include diols of the formula HO—$R^1$—OH wherein $R^1$ is a divalent aliphatic, alicyclic or aromatic radical of from 2 to 12 carbon atoms and includes hydrogen and carbon atoms and optionally, ether oxygen atoms.

Such aliphatic, alicyclic, and aromatic radicals include alkylene, cycloalkylene, arylene, alkylenearylene, alkylenecycloalkylene, alkylenebisarylene, cycloalkylenebisalkylene, arylenebisalkylene, alkylene-oxy-alkylene, alkylene-oxy-arylene-oxy-alkylene, arylene-oxy-alkylene, and alkylene-oxy-cycloalkylene-oxy-alkylene.

Exemplary diols include ethylene glycol, diethylene glycol, triethylene glycol, 1,3-propanediol, 1,4-butanediol, 2-methyl-1,5-pentanediol, neopentyl glycol, 1,4-cyclohexanedimethanol, 1,4-bis(β-hydroxyethoxy)cyclohexane, quinitol, norcamphanediols, 2,2,4,4-tetraalkylcyclobutane-1,3-diols, p-xylene diol, and Bisphenol A.

In one embodiment, the substantially amorphous polyesters described herein comprise diol recurring units of either of the formulae

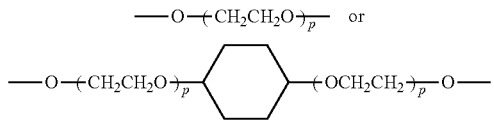

wherein p is an integer from 1 to 4. Such recurring units are present in the polyesters in an amount of at least 50 mole percent, and typically from about 50 to 100 mole percent, based on total moles of diol recurring units.

Amorphous polyester ionomers useful in the practice of this invention include poly[1,4-cyclohexylenedi(oxyethylene) 3,3'-[(sodioimino) disulfonyl]dibenzoate-co-succinate (5:95 molar ratio)], poly[1,4-cyclohexylenedi(oxy-ethylene)-co-ethylene (75:25 molar ratio) 3,3'-[(potassioimino) disulfonyl]dibenzoate-co-azelate (10:90 molar ratio)], poly [1,4-cyclohexylene-di(oxyethylene)3,3'-[(sodioimino) disulfonyl]-dibenzoate-co-adipate (95:5 molar ratio)], and poly[1,4-cyclohexylenedi(oxyethylene)3,3'-[(sodioimino)-disulfonyl]dibenzoate-co-3,3'-(1,4-phenylene)-dipropionate (20:80 molar ratio)].

Commercially available aqueous dispersible polyester ionomers suitable for this invention include Eastman AQ® polyester ionomers that are manufactured by Eastman Chemical Co. These polymers are described in Eastman chemical literature Publication CB-41A (December 2005), incorporated herein by reference.

The one or more polyester ionomers are present in the image receiving layer in an amount of at least 1 and up to and including 99 weight %, or typically at least 5 and up to and including 95 weight %, based on total layer dry weight. The weight ratio of the water-dispersible polymer to the polyester ionomer is generally at least 0.01:1 and up to and including 99:1.

When a polyester ionomer is present, the aqueous-coated image receiving layer also includes one or more crosslinking agents for the polyester ionomer. Representative crosslinking agents include but are not limited to, organic compounds including but not limited to, melamine formaldehyde resins, glycoluril formaldehyde resins, polycarboxylic acids and anhydrides, polyamines, epihalohydrins, diepoxides, dialdehydes, diols, carboxylic acid halide, ketenes, and combinations thereof. The best crosslinking agents are soluble or dispersible in water or water/alcohol mixtures. These compounds can be obtained from a number of commercial sources or prepared using known chemistry. A variety of suitable melamine formaldehyde and glycoluril formaldehyde crosslinking agents are available from Cytec Industries under the trademark Cymel® resins. Useful epihalohydrins included polyamide-epichlorohydrin crosslinking agents including those available from Hercules Inc. under the trademark POLYCUP® resins.

The crosslinking agents are generally present in an amount of at least 0.01 and up to and including 50 weight %, or typically at least 1 and up to and including 20 weight %, based on total layer dry weight.

The aqueous-coated image receiving layer can include other optional components including but not limited to antistatic agents (described below), various non-polyurea and non-polyurethane copolymers (such as polyesters, polycarbonates, polycyclohexylenedimethylene terephthalate, and vinyl modified polyester copolymers) as described for example in U.S. Pat. No. 7,189,676 (Bourdelais et al.), plasticizers such as monomeric and polymeric esters as described for example in Col. 4 of U.S. Pat. No. 7,514,028 (Kung et al.), UV absorbers, release agents, surfactants, defoamers, coating aids, charge control agents, thickeners or viscosity modifiers, antiblocking agents, coalescing aids, other crosslinking agents or hardeners, soluble or solid particle dyes, matte beads, inorganic or polymeric particles, adhesion promoting agents, bite solvents or chemical etchants, lubricants, antioxidants, stabilizers, colorants or tints, fillers and other addenda that are well-known in the art.

Useful antistatic agents include both organic and inorganic compounds that are electrically-conductive that can be either ionic conductors or electronic conductors. They can include simple inorganic salts, alkali metal salts or surfactants, charge control agents, ionic conductive polymers, electronically conductive polymers, polymeric electrolytes containing alkali metal salts, colloidal metal oxide sols and mixed metal oxide sols, conductive carbon including single-wall or multi-wall carbon nanotubes, and other useful compounds known in the art. These compounds can be incorporated into the aqueous-coated image receiving layer in appropriate amounts for a desired conductivity.

Alternatively or additionally, a separate antistatic layer can be incorporated in the support utilizing any of these or other antistatic agents. Among the noted antistatic agents, charge control agents such as non-ionic or ionic surfactants, conductive salts, colloidal metal oxides such as semiconducting tin oxide, mixed metal oxides such as semiconducting zinc antimonate or indium tin oxide, ionic conductive polymers such as polystyrene sulfonic acid or its salts, electronically conductive polymers such as polythiophene, polyaniline, or polypyrrole, and carbon nanotubes are particularly useful in these embodiments because of their effectiveness, transparency, or commercial availability.

In many embodiments, the aqueous-coated image receiving layer is the outermost layer of the image receiver element, but in some embodiments, the element further comprises an outermost layer disposed on the image receiving layer. This outermost layer can comprise one or more film-forming polymers and generally has a dry thickness of at least 0.1 and up to and including 1 μm.

The image receiving element generally has one or more additional layers between the support and the image receiving layer, and at least one of those additional layers can comprise an antistatic agent (such as one of those described above).

The support for the image receiving layer of the invention may be transparent or reflective. Typical imaging supports may comprise cellulose nitrate, cellulose acetate, poly(vinyl acetate), poly(vinyl alcohol), poly(ether sulfone), polystyrene, polyolefins including polyolefin ionomers, polyesters including polyester ionomers, polycarbonate, polyamide, polyimide, glass, ceramic, metal, natural and synthetic paper, resin-coated or laminated paper, voided polymers, polymeric foam, hollow beads and microballoons, woven or non-woven materials, fabric, or any combinations thereof. Useful supports comprise raw paper base, synthetic paper, and polymers such as polyesters, polyolefins and polystyrenes, mainly chosen for their desirable physical properties and cost. The support may be employed at any desired thickness, usually at least 10 μm and up to and including 1000 μm. For reflective supports, use of white pigments such as titania, zinc oxide, calcium carbonate, colorants, optical brighteners, and any other addenda known in the art is also contemplated.

In a useful embodiment, the support comprises a paper core that is either laminated or resin-coated on the image receiving side. If laminated, the laminate film on the image receiving side comprises a voided layer that provides a compliant and thermally diffusive layer suitable for thermal dye transfer, and optionally a skin layer on the compliant layer. The skin layer may be voided or non-voided, and may contain inorganic particles or colorants. Alternatively, if the paper core is resin-coated on the imaging side, it may have a compliant and thermally diffusive resin coating, optionally comprising a skin layer further comprising inorganic particles or colorants. The side of the paper core opposite to the image receiving side can also be laminated with a suitable film or resin-coated with a suitable resin. The laminate films used on the paper core typically comprise an oriented polymer, such as biaxially oriented polypropylene or polyester. The resin coating can comprise polyolefins such as polyethylene and polypropylene, polyolefin acrylates, polyurethane, polystyrene, or elastomeric polymers. Such supports are well known in the art, for example, as disclosed in commonly assigned U.S. Pat. Nos. 5,244,861 and 5,928,990 and EP 0671281A1 that are hereby incorporated by reference for such teaching.

In one embodiment, the aqueous layer is formed from a coating composition on the support surface of the image receiving side by any of the well known coating methods. The coating methods may include but not limited to, hopper coating, curtain coating, rod coating, gravure coating, roller coating, dip coating, and spray coating. The surface on which the coating composition is deposited can comprise any material including polyolefins, such as polyethylene and polypropylene, polystyrene, and polyester. Alternatively, the aqueous layer can be coated on a functional layer such as an antistatic layer already formed on the support. The surface on which the coating composition is deposited can be treated for improved adhesion by any of the means known in the art, such as acid etching, flame treatment, corona discharge treatment, or glow discharge treatment, or it can be coated with a suitable primer layer.

In some embodiments, the image receiver elements are "dual-sided", meaning that they have an image receiving layer (such as a thermal dye receiving layer) on both sides of the support.

Dye Donors Elements

Ink or thermal dye-donor elements that may be used with the image receiver element generally comprise a support having thereon an ink or dye containing layer.

Any ink or dye may be used in the thermal ink or dye-donor provided that it is transferable to the thermal ink or dye-receiving or recording layer by the action of heat. Ink or dye donor elements useful with the present invention are described, for example, in U.S. Pat. Nos. 4,916,112, 4,927,803, and 5,023,228 that are all incorporated herein by reference. As noted above, ink or dye-donor elements may be used to form an ink or dye transfer image. Such a process comprises image-wise-heating an ink or dye-donor element and transferring an ink or dye image to an ink or dye-receiving or recording element as described above to form the ink or dye transfer image. In the thermal ink or dye transfer method of printing, an ink or dye donor element may be employed that comprises a poly(ethylene terephthalate) support coated with sequential repeating areas of cyan, magenta, or yellow ink or dye, and the ink or dye transfer steps may be sequentially performed for each color to obtain a multi-color ink or dye transfer image. The support may also include a clear protective layer that can be transferred onto the transferred dye images. When the process is performed using only a single color, then a monochrome ink or dye transfer image may be obtained.

Dye-donor elements that may be used with the dye-receiving element used in the invention conventionally comprise a support having thereon a dye containing layer. Any dye can be used in the dye layer of the dye-donor element of the invention provided it is transferable to the dye-receiving layer by the action of heat. Especially good results have been obtained with diffusible dyes, such as the magenta dyes described in U.S. Pat. No. 7,160,664 (Goswami et al.) that is incorporated herein by reference.

The dye-donor layer can include a single color area (or patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone methine dye, and a cyan dye-donor patch comprising at least one indoaniline cyan dye.

Any dye transferable by heat can be used in the dye-donor layer of the dye-donor element. The dye can be selected by taking into consideration hue, lightfastness, and solubility of the dye in the dye donor layer binder and the dye image receiving layer binder.

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, 7,501,382 (Foster et al.), and U.S. Patent Application Publications 2003/0181331 and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of at least 0.05 $g/m^2$ and up to and including 1 $g/m^2$ of coverage. According to various embodiments, the dyes can be hydrophobic.

Imaging and Assemblies

As noted above, dye donor elements and image receiver elements can be used to form a dye transfer image. Such a process can comprise imagewise-heating a thermal dye donor element and transferring a dye image to a thermal dye receiver element of this invention as described above to form the dye transfer image.

In one embodiment of the invention, a thermal dye donor element may be employed which comprises a poly(ethylene terephthalate) support coated with sequential repeating areas of cyan, magenta and yellow dye, and the dye transfer steps are sequentially performed for each color to obtain a three-color dye transfer image. The dye donor element may also contain a colorless area that may be transferred to the image receiving element to provide a protective overcoat.

Thermal printing heads which may be used to transfer ink or dye from ink or dye-donor elements to an image receiver element may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, in GB Publication 2,083,726A that is incorporated herein by reference.

In another embodiment, the imaging element may be an electrophotographic imaging element wherein the antistatic properties are optimized for the needs of the electrophotographic process. The electrographic and electrophotographic processes and their individual steps have been well described in the prior art, for example in U.S. Pat. No. 2,297,691 (Carlson). The processes incorporate the basic steps of creating an electrostatic image, developing that image with charged, colored particles (toner), optionally transferring the resulting developed image to a secondary substrate, and fixing the image to the substrate. There are numerous variations in these processes and basic steps such as the use of liquid toners in place of dry toners is simply one of those variations.

The first basic step, creation of an electrostatic image, may be accomplished by a variety of methods. The electrophotographic process of copiers uses photodischarge, through analog or digital exposure, of a uniformly charged photoconductor. The photoconductor may be a single use system, or it may be rechargeable and re-imageable, like those based on selenium or organic photoreceptors.

In an alternate electrographic process, electrostatic images are created sonographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a re-imageable photoreceptor or an electrographic master is used, the toned image is transferred to an electrophotographic image receiving element. The receiving element is charged electrostatically, with the polarity chosen to cause the toner particles to transfer to the receiving element. Finally, the toned image is fixed to the receiving element. For self-fixing toners, residual liquid is removed from the receiving element by air drying or heating. Upon evaporation of the solvent, these toners form a film bonded to the receiving element. For heat-fusible toners, thermoplastic polymers are used as part of the particle. Heating both removes residual liquid and fixes the toner to receiving element.

In another embodiment of this invention, the image receiver element can be used to receive a wax-based ink from an ink jet printer using what is known as a "phase change ink" that is transferred as described for example in U.S. Pat. Nos. 7,381,254 (Wu et al.), 7,541,406 (Banning et al.), and 7,501,015 (Odell et al.) that are incorporated herein by reference.

A thermal transfer assemblage may comprise (a) an ink or dye-donor element, and (b) an ink or dye image receiver element of this invention, the ink or dye image receiver element being in a superposed relationship with the ink or dye donor element so that the ink or dye layer of the donor element may be in contact with the ink or thermal dye image receiving layer. Imaging can be obtained with this assembly using known processes.

When a three-color image is to be obtained, the above assemblage may be formed on three occasions during the time when heat may be applied by the thermal printing head. After the first dye is transferred, the elements may be peeled apart. A second dye donor element (or another area of the donor element with a different dye area) may be then brought in register with the thermal dye receiving layer and the process repeated. The third color may be obtained in the same manner.

The following embodiments are representative of those included within the present invention:

1. A thermal, non-silver halide-containing image receiver element comprising a support and having thereon an aqueous-coated image receiving layer comprising:

a) a water-dispersible polymer having a polyurea or polyurethane backbone and up to 25 weight % of the water-dispersible polymer comprising polysiloxane side chains that are covalently attached to the backbone, each of the side chains having a molecular weight of at least 500.

2. The element of embodiment 1 wherein the image receiving layer further comprises:

b) a crosslinkable water-dispersible polyester ionomer having a Tg of at least 0 and up to and including 100° C., and c) a crosslinking agent for the polyester ionomer.

3. The element of embodiment 2 wherein the water-dispersible polymer is present in an amount of at least 1 and up to and including 99 weight %, the polyester ionomer is present in an amount of at least 99 and up to and including 1 weight %, and the crosslinking agent is present in an amount of at least 0.01 and up to and including 20 weight %, all based on total image receiving layer dry weight.

4. The element of embodiment 2 or 3 wherein the weight ratio of the water-dispersible polymer to the polyester ionomer is at least 0.01:1 and up to and including 99:1.

5. The element of any of embodiments 1 to 4 wherein the polysiloxane side chains are derived from a siloxane-containing diol or diamine and can be represented by the following Structure (SX-1):

(SX-1)

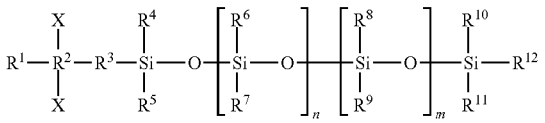

wherein X is an amino or hydroxyl group, $R^1$ through $R^{12}$ are independently alkyl or aryl groups, and n and m are independently 0 to 500 such that the sum of n and m is at least 10 and up to and including 500.

6. The element of any of embodiments 1 to 5 wherein the polysiloxane side chains comprise at least 5 and up to and including 20 weight % of the water-dispersible polymer.

7. The element of any of embodiments 2 to 6 wherein the polyester ionomer has a Tg of at least 20 and up to and including 80° C. and comprises recurring units comprising anionic moieties.

8. The element of any of embodiments 1 to 7 wherein the image receiving layer is the outermost layer.

9. The element of any embodiments 1 to 7 further comprising an outermost layer disposed on the image receiving layer, which outermost layer has a dry thickness of at least 0.1 and up to and including 1 μm.

10. The element of any of embodiments 1 to 9 further comprising one or more additional layers between the support and the image receiving layer, at least one of said additional layers comprising an antistatic agent.

11. The element of any of embodiments 1 to 10 wherein the image receiving layer further comprises an antistatic agent.

12. The element of any of embodiments 1 to 11 that is a thermal dye image receiver element.

13. The element of any of embodiments 1 to 12 wherein the image receiving layer is a thermal dye image receiving layer and the support is composed of a cellulosic raw paper base or synthetic paper base.

14. The element of embodiment 12 or 13 comprising, in order, the thermal dye image receiving layer, an antistatic tie layer, a compliant layer or microvoided film, and the support.

15. The element of embodiment 14 wherein the compliant layer is an extruded layer and the element further comprises a skin layer immediately adjacent one or both sides of the compliant layer.

16. An imaging assembly comprising the image receiver element of any of embodiments 1 to 15 in thermal association with a thermal dye donor element.

17. The imaging assembly of embodiment 16 wherein the image receiving layer of the image receiver element further comprises:

b) a crosslinkable water-dispersible polyester ionomer, and c) a crosslinking agent for the polyester ionomer, the water-dispersible polymer is present in an amount of at least 1 and up to and including 99 weight %, the polyester ionomer is present in an amount of at least 99 and up to and including 1 weight %, and the crosslinking agent is present in an amount of at least 0.01 and up to and including 20 weight %, all based on total image receiving layer dry weight, the weight ratio of the water-dispersible polymer to the polyester ionomer is at least 0.01:1 and up to and including 99:1, and the polysiloxane side chains are derived from a siloxane-containing diol or diamine and can be represented by the following Structure (SX-1):

(SX-1)

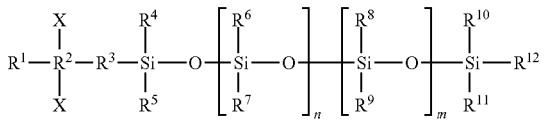

wherein X is an amino or hydroxyl group, $R^1$ through $R^{12}$ are independently alkyl or aryl groups, and n and m are independently 0 to 500 such that the sum of n and m is at least 10 and up to and including 500.

The following Examples are provided to illustrate the practice of the present invention, but the invention is not to be limited by the Examples in any manner.

EXAMPLES

The following polyurethane latexes comprising pendant polysiloxane side chains were prepared and used in image receiving layers in the practice of this invention, Invention Examples 1-13:

Latex A:

In a 5-liter, three-necked round bottom flask equipped with a stirrer, water condenser, and nitrogen inlet were placed 116.34 g (0.058 moles) of Terathane polyether polyol (average Mn=2000) (Aldrich) followed by 119.38 g (0.89 moles) of 2,2-bis(hydroxymethyl)propionic acid (DMPA), 52.0 g (0.052 moles) of Silaplane/Mono-terminal Chisso Siloxane FM-DA11, (average Mw=1000), 600 g of tetrahydrofuran (THF), and 1.25 g of dibutyltin dilaurate (catalyst). The reaction temperature was adjusted to 65° C. When a homogenous solution was obtained, 211.16 g (0.95 moles) of isophrone diisocyanate (IPDI) were slowly added followed by 10 g of THF. The temperature was raised to 75° C. and maintained for 24 hours to complete the reaction, resulting in an intermediate containing no residual free isocyanate. The free isocyanate content was monitored by the disappearance of the NCO absorption peak by infrared spectroscopy.

The reaction mixture was then diluted with THF and neutralized with triethylamine to 100% stoichiometric neutralization of the carboxylic acid, followed by the addition of 1500 g of distilled water under high shear to form a stable aqueous dispersion. THF was removed by heating under vacuum and the resultant aqueous dispersion was filtered. The resulting polyurethane had a Mw of about 23,900 determined by SEC and an acid number of about 100.

Latex B:

In a 1-liter, three-necked round bottom flask equipped with a stirrer, water condenser, and nitrogen inlet were placed 56.17 g (0.028 moles) of Terathane polyether polyol (average Mn=2000) followed by 27.70 g (0.2065 moles) of 2,2-bis (hydroxymethyl)propionic acid (DMPA), 15.5 g (0.0155 moles) of Silaplane/Mono-terminal Chisso Siloxane FM-DA11, (average Mw=1000), 150 g of tetrahydrofuran (THF), and 0.5 ml of dibutyltin dilaurate (catalyst). The temperature was adjusted to 65° C. When a homogenous solution was obtained, 52.79 g (0.2375 moles) of isophrone diisocyanate (IPDI) were slowly added followed by 10 g of THF. The reaction temperature was raised to 75° C. and maintained for 24 hours to complete the reaction, resulting in an intermediate containing no residual free isocyanate. The free isocyanate content was monitored by the disappearance of the NCO absorption peak by infrared spectroscopy.

The reaction mixture was diluted with THF and neutralized with triethylamine to 100% stoichiometric neutralization of the carboxylic acid, followed by the addition of 450 g of distilled water under high shear to form a stable aqueous dispersion. THF was removed by heating under vacuum and the resultant aqueous dispersion was filtered. The resulting polyurethane had a Mw of about 29,700 determined by SEC and an acid number of about 76.

Latex C:

In a 1-liter, three-necked round bottom flask equipped with a stirrer, water condenser, and nitrogen inlet were placed 102.31 g (0.051 moles) of Terathane polyether polyol (average Mn=2000) followed by 24.01 g (0.179 moles) of 2,2-bis (hydroxymethyl)propionic acid (DMPA), 20 g (0.02 moles) of Silaplane/Mono-terminal Chisso Siloxane FM-DA11, (average Mw=1000), 150 g of tetrahydrofuran (THF), and 0.5 ml of dibutyltin dilaurate (catalyst). The reaction temperature was adjusted to 65° C. When a homogenous solution was obtained, 52.79 g (0.2375 moles) of isophrone diisocyanate (IPDI) was slowly added followed by 10 g of THF. The reaction temperature was raised to 75° C. and maintained for 48 hours to complete the reaction, resulting in an intermediate containing no residual free isocyanate. The free isocyanate content was monitored by the disappearance of the NCO absorption peak by infrared spectroscopy.

The reaction mixture was diluted with THF and neutralized with triethylamine to 100% stoichiometric neutralization of the carboxylic acid, followed by the addition of 600 g of distilled water under high shear to form a stable aqueous dispersion. THF was then removed by heating under vacuum and the resultant aqueous dispersion was filtered. The resulting polyurethane had a Mw of about 42,400 determined by SEC and an acid number of about 50.

The following polyurethane latexes were prepared without any siloxane moiety and used in image receiving layers in the Comparative Examples 1-5:

Latex X:

In a 2-liter, three-necked round bottom flask equipped with a stirrer, water condenser, and nitrogen inlet were placed 55 g (0.0275 moles) of poly(hexamethylene carbonate)diol (PHMC) (average Mn=2000) (Aldrich) followed by 10.81 g (0.0806 moles) of 2,2-bis(hydroxymethyl)propionic acid (DMPA), 12.79 g (0.1419 moles) of 1,4-butanediol, 150 g of ethyl acetate (EA), and 0.5 ml of dibutyltin dilaurate (catalyst). The reaction temperature was adjusted to 65° C. When a homogenous solution was obtained, 55.57 g (0.25 moles) of isophrone diisocyanate (IPDI) were slowly added followed by 10 g of EA. The reaction temperature was raised to 75° C. and maintained for 24 hours to complete the reaction, resulting in an intermediate containing no residual free isocyanate. The free isocyanate content was monitored by the disappearance of the NCO absorption peak by infrared spectroscopy.

The reaction mixture was diluted with EA and neutralized with triethylamine to 100% stoichiometric neutralization of the carboxylic acid, followed by the addition of 400 g of distilled water under high shear to form a stable aqueous dispersion. EA was removed by heating under vacuum and the resultant aqueous dispersion was filtered. The resulting polyurethane had a Mw of about 28,200 by SEC and an acid number of about 34.

Latex Y:

In a 2-liter, three-necked round bottom flask equipped with a thermometer, stirrer, water condenser, and nitrogen inlet were placed 55 g (0.0275 moles) of poly(hexamethylene carbonate)diol (PHMC) (average Mn=2000) followed by 11.40 g (0.085 moles) of 2,2-bis(hydroxymethyl)propionic acid (DMPA), 12.39 g (0.1375 moles) of 1,4-butanediol, 160 g of Ethyl Acetate (EA), and 0.5 ml of dibutyltin dilaurate (catalyst). The reaction temperature was adjusted to 65° C. When a homogenous solution was obtained, 62.24 g (0.28 moles) of isophrone diisocyanate (IPDI) were slowly added followed by 10 g of EA. The reaction temperature was raised to 75° C. and maintained for 48 hours, followed by addition of a monofunctional alcohol to terminate the reaction. The free isocyanate content was monitored by the disappearance of the NCO absorption peak by infrared spectroscopy.

The reaction mixture was diluted with EA and neutralized with triethylamine to 100% stoichiometric neutralization of the carboxylic acid, followed by the addition of 600 g of distilled water under high shear to form a stable aqueous dispersion. EA was removed by heating under vacuum and the resultant aqueous dispersion was filtered. The resulting polyurethane had a Mw of about 254,000 by SEC and an acid number of about 34.

The other ingredients used in the dye receiving layers of the Invention and Comparative Examples were as follows:

AQ55D is a polyester ionomer dispersion obtained from Eastman Chemicals,

Cymel® is a methylated melamine resin obtained from Cytec Corporation,

CX100 is a polyaziridine obtained from DSM NeoResins, Inc., and ME61335 is a polyethylene wax emulsion obtained from Michemlube.

The thermal receiver supports used in the Invention and Comparative Examples are described as follows:

The thermal receiver supports comprised a paper core laminated on both the image receiving side and the opposite side with BOPP (Biaxially oriented polypropylene) films. The BOPP film on the image receiving side was a commercially available packaging film OPPalyte® 350 TW made by Exxon Mobil. OPPalyte® 350 TW is a composite film (38 μm thick) (specific gravity 0.62) consisting of a microvoided and oriented polypropylene core (approximately 73% of the total film thickness) with a titanium dioxide pigmented non-microvoided oriented polypropylene layer co-extruded on each side. The void-initiating material is poly(butylene terephthalate). The BOPP film on the opposite side was a commercially available oriented polypropylene film Bicor® 70 MLT made by Exxon Mobil. Bicor® 70MLT (18 μm thick) (specific gravity 0.9) is a one side matte finish and one side treated polypropylene film comprising a non-microvoided polypropylene core.

The thermal receiver support was treated with corona discharge and coated with an aqueous antistatic subbing layer having the following dry composition and coverage:

Conductive acicular tin oxide FS 10D (obtained from Ishihara) 15 mg/ft$^2$ (162 mg/m$^2$), and polyurethane latex primer NeoRez® R600 (obtained from DSM NeoResins, Inc.) 15 mg/ft$^2$ (162 mg/m$^2$) and a total antistatic subbing layer dry coverage of 30 mg/ft$^2$ (324 mg/m$^2$).

The dye receiving layers of the Invention and Comparative Examples were coated from aqueous formulations over the antistatic subbing layer as described below. The Invention and Comparative Examples were evaluated for printability (such as donor/receiver elements sticking) in a Kodak® Photo Printer 6850 using a Kodak Professional EKTATHERM ribbon, catalogue number 106-7347 coated with cyan, magenta, and yellow dyes in cellulose acetate propionate binder and a poly(vinyl acetal)-based protective overcoat. Some of these prints were further evaluated for $D_{max}$ density. Water-fastness was evaluated by soaking some of these prints in water for at least 12 hours, followed by air drying and inspection for damage or loss of print quality.

The following TABLES I-IV show the results from the Invention and Comparative Examples illustrating the various characteristics and advantages of the present invention.

TABLE I

| Composition or Property | Comparative Example 1 Dry coverage | Comparative Example 2 Dry coverage | Comparative Example 3 Dry coverage | Comparative Example 4 Dry coverage |
|---|---|---|---|---|
| Latex X | 3.24 g/m$^2$ | 3.24 g/m$^2$ | 3.24 g/m$^2$ | 0 |
| Latex Y | 0 | 0 | 0 | 3.24 g/m$^2$ |
| CX100 | 162 mg/m$^2$ | 324 mg/m$^2$ | 486 mg/m$^2$ | 324 mg/m$^2$ |
| ME61335 | 540 mg/m$^2$ | 540 mg/m$^2$ | 540 mg/m$^2$ | 540 mg/m$^2$ |
| Printability | Severe sticking; failure | Severe sticking; failure | Severe sticking; failure | Severe sticking; failure |

TABLE II

| Composition or Property | Invention Example 1 Dry coverage | Invention Example 2 Dry coverage | Invention Example 3 Dry coverage | Invention Example 4 Dry coverage | Invention Example 5 Dry coverage | Invention Example 6 Dry coverage |
|---|---|---|---|---|---|---|
| Latex A | 3.24 g/m$^2$ | 3.24 g/m$^2$ | 3.24 g/m$^2$ | 3.24 g/m$^2$ | 3.24 g/m$^2$ | 3.24 g/m$^2$ |
| CX100 | 162 mg/m$^2$ | 324 mg/m$^2$ | 486 mg/m$^2$ | 162 mg/m$^2$ | 324 mg/m$^2$ | 486 mg/m$^2$ |
| ME61335 | 0 | 0 | 0 | 540 mg/m$^2$ | 540 mg/m$^2$ | 540 mg/m$^2$ |
| Printability | No sticking; success | No sticking; success | No sticking; success | No sticking; success | No sticking; success | No sticking; success |

TABLES I and II clearly show that the use of a polyurethane latex comprising a pendant side chain having siloxane moieties (Latex A) provides an image receiving layer that can be printed with a typical Thermal donor (TABLE II). However, the polyurethane latexes used in the Comparative Examples without pendant siloxane groups (Latex X and Latex Y) provided very poor results as the image receiving layers could not be printed because of severe donor/receiver sticking (TABLE I).

TABLE III

| Composition or Property | Comparative Example 5 Dry coverage | Invention Example 7 Dry coverage | Invention Example 8 Dry coverage | Invention Example 9 Dry coverage |
|---|---|---|---|---|
| AQ 55D | 1.94 g/m$^2$ | 0 | 1.42 g/m$^2$ | 1.42 g/m$^2$ |
| Latex A | 0 | 1.94 g/m$^2$ | 486 mg/m$^2$ | 486 mg/m$^2$ |
| Cymel ® 303 | 167 mg/m$^2$ | 0 | 0 | 109 mg/m$^2$ |
| CX100 | 0 | 389 mg/m$^2$ | 122 mg/m$^2$ | 122 mg/m$^2$ |
| Printability | Moderate sticking | No sticking; success | No sticking; success | No sticking; success |
| Water fastness | Success | Success | Failure | Success |
| $D_{max}$ Density | | 1.5 | | 1.9 |

TABLE III shows that using the polyester ionomer alone (without the modified polyurethane) caused moderate sticking in the printer (Comparative Example 5). However, when the polyester ionomer was blended with a polyurethane latex comprising a pendant side chain having siloxane moieties (Latex A) the image receiving layer became printable (Invention Examples 8 and 9). Moreover, the image receiving layer of the invention (Invention Example 9) provided higher $D_{max}$ density than use of the polyurethane alone (Invention Example 7), demonstrating further improvement with the blended composition. The data in TABLE III further demonstrate that the presence of a melamine resin (as a crosslinking agent for the polyester ionomer) provided improved water-fastness (Invention Example 9) showing its presence to be highly desirable compared to its absence (Invention Example 8).

TABLE IV

| Composition or Property | Invention Example 10 Dry coverage | Invention Example 11 Dry coverage | Invention Example 12 Dry coverage | Invention Example 13 Dry coverage |
|---|---|---|---|---|
| AQ 55D | 1.46 g/m$^2$ | 1.75 g/m$^2$ | 1.46 g/m$^2$ | 1.75 g/m$^2$ |
| Latex B | 486 mg/m$^2$ | 194 mg/m$^2$ | 0 | 0 |
| Latex C | 0 | 0 | 486 mg/m$^2$ | 194 mg/m$^2$ |
| Cymel ® 303 | 109 mg/m$^2$ | 132 mg/m$^2$ | 109 mg/m$^2$ | 132 mg/m$^2$ |
| CX100 | 58.3 mg/m$^2$ | 23.8 mg/m$^2$ | 87.5 mg/m$^2$ | 34.6 mg/m$^2$ |
| Printability | Success | Success | Success | Success |
| Water fastness | Success | Success | Success | Success |
| $D_{max}$ Density | 1.9 | 1.9 | 1.8 | 1.8 |

The data in TABLE IV show additional Invention examples of dye receiver layers that comprise blends of polyester ionomer, polyurethane latex comprising a pendant side chains having siloxane moieties, and a melamine resin crosslinking agent. These Invention Examples demonstrate desirable characteristics such as printability, water fastness, and high $D_{max}$ print density.

The invention has been described in detail with particular reference to certain preferred embodiments thereof, but it will be understood that variations and modifications can be effected within the spirit and scope of the invention.

The invention claimed is:

1. A thermal, non-silver halide-containing image receiver element comprising a support and having thereon an aqueous-coated image receiving layer comprising:

a) a water-dispersible polymer having a polyurea or polyurethane backbone and up to 25 weight % of the water-dispersible polymer comprising polysiloxane side chains that are covalently attached to the backbone, each of the side chains having a molecular weight of at least 500.

2. The element of claim 1 wherein the image receiving layer further comprises:

b) a crosslinkable water-dispersible polyester ionomer having a Tg of at least 0 and up to and including 100° C., and c) a crosslinking agent for the polyester ionomer.

3. The element of claim 2 wherein the water-dispersible polymer is present in an amount of at least 1 and up to and including 95 weight %, the polyester ionomer is present in an amount of at least 1 and up to and including 95 weight %, and the crosslinking agent is present in an amount of at least 0.1 and up to and including 20 weight %, all based on total image receiving layer dry weight.

4. The element of claim 2 wherein the weight ratio of the water-dispersible polymer to the polyester ionomer is at least 0.01:1 and up to and including 99:1.

5. The element of claim 2 wherein the polyester ionomer has a Tg of at least 20 and up to and including 80° C. and comprises recurring units comprising anionic moieties.

6. The element of claim 1 wherein the polysiloxane side chains are derived from a siloxane-containing diol or diamine and is represented by the following Structure (SX-1):

(SX-1)

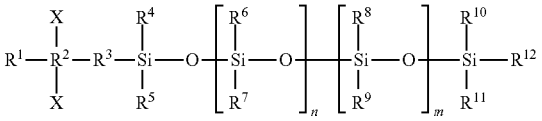

wherein X is an amino or hydroxyl group, $R^1$ through $R^{12}$ are independently alkyl or aryl groups, and n and m are independently 0 to 500 such that the sum of n and m is at least 10 and up to and including 500.

7. The element of claim 1 wherein the polysiloxane side chains comprise at least 5 and up to and including 20 weight % of the water-dispersible polymer.

8. The element of claim 1 wherein the image receiving layer is the outermost layer.

9. The element of claim 1 further comprising an outermost layer disposed on the image receiving layer, which outermost layer has a dry thickness of at least 0.1 and up to and including 1 μm.

10. The element of claim 1 further comprising one or more additional layers between the support and the image receiving layer, at least one of said additional layers comprising an antistatic agent.

11. The element of claim 1 wherein the image receiving layer further comprises an antistatic agent.

12. The element of claim 1 that is a thermal dye image receiver element.

13. The element of claim 12 wherein the image receiving layer is a thermal dye image receiving layer and the support is composed of a cellulosic raw paper base or synthetic paper base.

14. The element of claim 13 comprising, in order, the thermal dye image receiving layer, an antistatic tie layer, a compliant layer or microvoided film, and the support.

15. The element of claim 14 wherein the compliant layer is an extruded layer and the element further comprises a skin layer immediately adjacent one or both sides of the compliant layer.

16. An imaging assembly comprising the image receiver element of claim 1 in thermal association with a thermal dye donor element.

17. The imaging assembly of claim 16 wherein the image receiving layer of the image receiver element further comprises:

b) a crosslinkable water-dispersible polyester ionomer, and c) a crosslinking agent for the polyester ionomer, the water-dispersible polymer is present in an amount of at least 1 and up to and including 95 weight %, the polyester ionomer is present in an amount of at least 1 and up to and including 95 weight %, and the crosslinking agent is present in an amount of at least 0.01 and up to and including 20 weight %, all based on total image receiving layer dry weight, the weight ratio of the water-dispersible polymer to the polyester ionomer is at least 0.01:1 and up to and including 99:1, and the polysiloxane side chains are derived from a siloxane-containing diol or diamine and is represented by the following Structure (SX-1):

(SX-1)

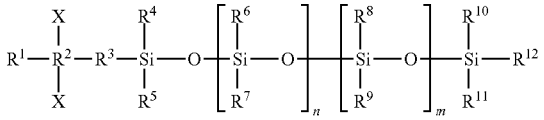

wherein X is an amino or hydroxyl group, $R^1$ through $R^{12}$ are independently alkyl or aryl groups, and n and m are independently 0 to 500 such that the sum of n and m is at least 10 and up to and including 500.

* * * * *